US005187898A

United States Patent [19]

McKann

[11] Patent Number: 5,187,898

[45] Date of Patent: Feb. 23, 1993

[54] ADJUSTABLE DOOR FRAME

[75] Inventor: H. Smith McKann, Fredericksburg, Va.

[73] Assignee: General Products Company, Inc., Fredericksburg, Va.

[21] Appl. No.: 858,515

[22] Filed: Mar. 27, 1992

[51] Int. Cl.[5] ..... E06B 1/04

[52] U.S. Cl. ..... 49/505; 52/217

[58] Field of Search ..... 49/505; 52/212, 217

[56] References Cited

U.S. PATENT DOCUMENTS

| | | | |
|---|---|---|---|
| 1,048,988 | 12/1912 | Mayo | 52/217 |
| 1,715,579 | 6/1929 | Thye | 52/212 |
| 2,742,117 | 4/1956 | Tolman | 49/505 |
| 2,860,744 | 11/1958 | Mascari | 52/212 |
| 2,893,070 | 7/1959 | Gauthier | 49/505 |
| 3,032,837 | 5/1962 | Ramsey | 49/505 |
| 3,324,599 | 6/1967 | Brost | 49/505 |
| 3,364,624 | 1/1968 | Davis | 49/505 |
| 3,420,003 | 1/1979 | Cline | 52/217 |
| 3,520,085 | 7/1970 | Pond | 49/505 |
| 3,545,135 | 12/1970 | Lieber | 49/505 |
| 3,654,734 | 4/1972 | Lehman | 49/505 |
| 3,788,019 | 1/1974 | Kiselewski | 49/505 |
| 3,800,488 | 4/1974 | Swanson | 52/217 |
| 3,826,050 | 7/1974 | Schwartz | 49/505 |
| 3,881,279 | 5/1975 | Kirton | 49/505 |
| 3,906,671 | 9/1975 | Maldonado | 49/505 |
| 4,395,855 | 8/1983 | Juker | 49/505 |
| 4,589,229 | 5/1986 | Warren | 49/505 |
| 4,782,630 | 11/1988 | Kleyn | 49/505 |
| 4,787,184 | 11/1988 | Broidon | 52/217 |
| 4,791,758 | 12/1988 | Bauer | 49/505 |
| 4,793,109 | 12/1988 | Noach | 52/211 |
| 4,813,204 | 3/1989 | Rentscheler | 49/505 |
| 4,878,325 | 11/1989 | Van Tuyl | 49/505 |
| 4,912,879 | 4/1990 | Mozuras | 49/505 |
| 4,986,034 | 1/1991 | Mozuras | 49/505 |
| 4,986,044 | 1/1991 | Funari | 52/217 |

FOREIGN PATENT DOCUMENTS

| | | | |
|---|---|---|---|
| 2422180 | 11/1975 | Fed. Rep. of Germany | 49/505 |

*Primary Examiner*—Philip C. Kannan

*Attorney, Agent, or Firm*—Roylance, Abrams, Berdo & Goodman

[57] ABSTRACT

An adjustable door frame includes a latch jamb, a hinge jamb, two closure jambs, a base header and a closure header, each of which is unitarily formed of sheet metal. The jambs and headers are adjustably connected to accommodate variations in wall thicknesses. Each of the latch jamb, hinge jamb and base header has a flange section overlying the wall, an inside section extending into the doorway opening, a door abutment section extending perpendicularly into the doorway and a tongue section extending perpendicularly from the abutment section. Each of the closure jambs and closure header has a flange section for overlying the opposite wall surface, an inside section extending into the doorway and a folded back section defining a slot frictionally engaging the tongue sections.

20 Claims, 2 Drawing Sheets 24
22
22
24
14
80
54
82
56
64
30
58
68
12
108
48
42
44
38
20
50
70
52
46
32
78
76
40
110
66
74
36
34
72

102
10
88
68
116
32
114
112
86

24
24
14
22
54
80
56
82
30
58
84
64
86
18
96
96
90
60
104
48
12
38
50
52
32
98
106
34
78
70
68
92
100
94
100
102
36
74
76
66
88
72

10
46
40
36
72
74
66
28
34
76
78
68
52
70
32
50
60
44
38
42
48
16
26
58
84
64
30
82
56
54
22
80
14
24
24

ADJUSTABLE DOOR FRAME

FIELD OF THE INVENTION

The present invention relates to an adjustable door frame formed of sheet metal. First and second members form each side jamb assembly and header assembly, with the connection between the respective first and second members of each assembly being adjustable to compensate for varying wall thicknesses.

BACKGROUND OF THE INVENTION

Conventional building industry practice uses prefabricated door frame assemblies which are manufactured at a manufacturing facility and then transported to a remote location for installation. This door frame includes a header assembly for the top of the doorway opening and latch and hinge jamb assemblies for the sides of the doorway opening in the wall.

The thickness of the wall in which the door is to be located often varies. These variations result from variations in the standard materials used as well as in the assembly of those materials in forming the walls. To accommodate these thickness variations in the wall, the frame must be adjustable.

Additionally, the frame should be adaptable to a wide variety of uses, including the addition of a screen or storm door and the addition or omission of exterior trim.

To minimize expenditures in manufacturing, the latch and hinge jamb assemblies and the header assembly should be of generally the same construction.

With the increasing cost of wood, metal frames, particularly those of steel, have become viable for residential use, as well as for commercial use. Thus, the use of metal door frames is expanding.

SUMMARY OF THE INVENTION

Accordingly, an object of the present invention is to provide an adjustable door frame which can be easily, economically manufactured of sheet metal.

Another object of the present invention is to provide an adjustable door frame with the same structure for the latch jamb, hinge jamb and header assemblies.

A further object of the present invention is to provide an adjustable door frame which is adaptable to receive a screen or storm door, and can be used with or without exterior trim.

Yet another object of the present invention is to provide an adjustable door frame which is rugged, sturdy, and easy to install.

The foregoing objects are provided by an adjustable door frame comprising first and second members, each of which is unitarily formed of sheet metal. The first member includes a first flange section for overlying a wall surface adjacent the wall doorway opening, a first inside section extending substantially perpendicularly from the first flange section for extending into the doorway opening, a first door abutment section extending substantially perpendicularly from the first inside section at an end thereof remote from the first flange section in a direction parallel to and opposite to the first flange section, and a tongue section extending substantially perpendicularly from the first abutment section at its end remote from the first inside section in a direction parallel to and opposite to the first inside section. The second member includes a second flange section for overlying the opposite side of the wall, a second inside section extending substantially perpendicularly from the second flange section for extending into the doorway opening toward and adjacent to the first inside section, and a folded back section extending from the second inside section at its end remote from the second flange section and defining a slot. The slot receives and frictionally engages the tongue section of the first member.

By forming the frame in this matter, the engagement of the tongue section in the slot provides an adjustable connection of the first and second members. This adjustable connection will compensate for varying wall thicknesses, while providing a structure which is sturdy, simple to install and manufacture, inexpensive to manufacture, and is highly adaptable to varied uses.

According to a preferred embodiment of the present invention, a groove is provided in the first door abutment section adjacent to the respective inside section for retaining a seal. This provides the seal in an effective location which is stable.

Other objects, advantages, and salient features of the present invention will become apparent from the following detailed description, which, taken into conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
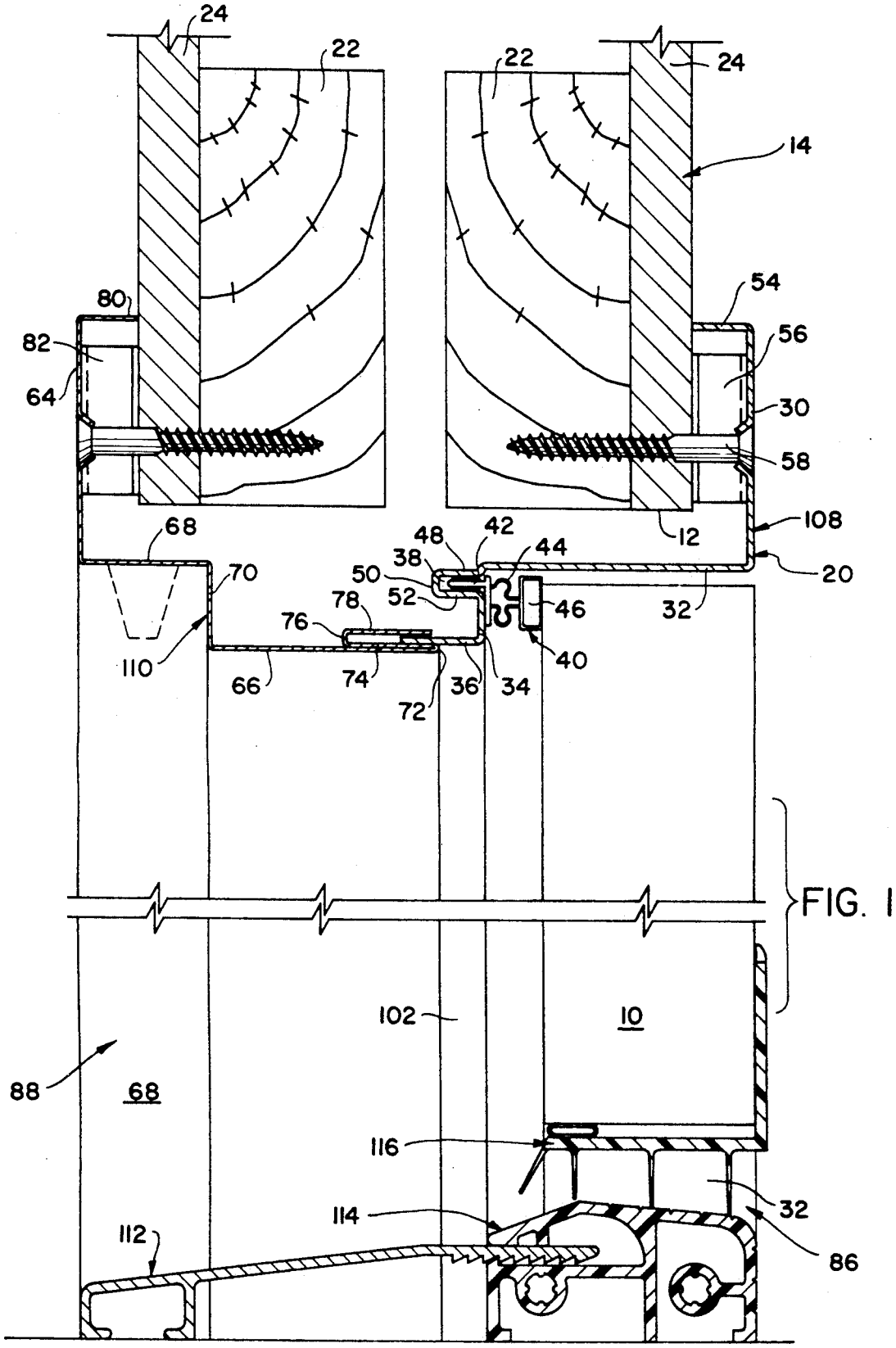
FIG. 1 is a partial, side elevational view in section of adjustable door frame according to the present invention.

The adjustable door frame of the present invention pivotally mounts a door 10 in a doorway 12 in a wall 14. The door frame includes a latch jamb assembly 16, a hinge jamb assembly 18, and a header assembly 20. Each of these three assemblies is formed of two mating members. The cross-sectional shapes of the two members in each assembly are essentially identical.

The wall 14 having the doorway 12 can be of any conventional form. For example, the wall can include wood studs 22 on which dry wall panels 24 are mounted. The dimensional variations in the studs and dry wall panels, as well as the assembly thereof, produce the variations in the thickness of the entire wall, that is, between the oppositely directed surfaces of the dry wall panels 24.

Figure 2:
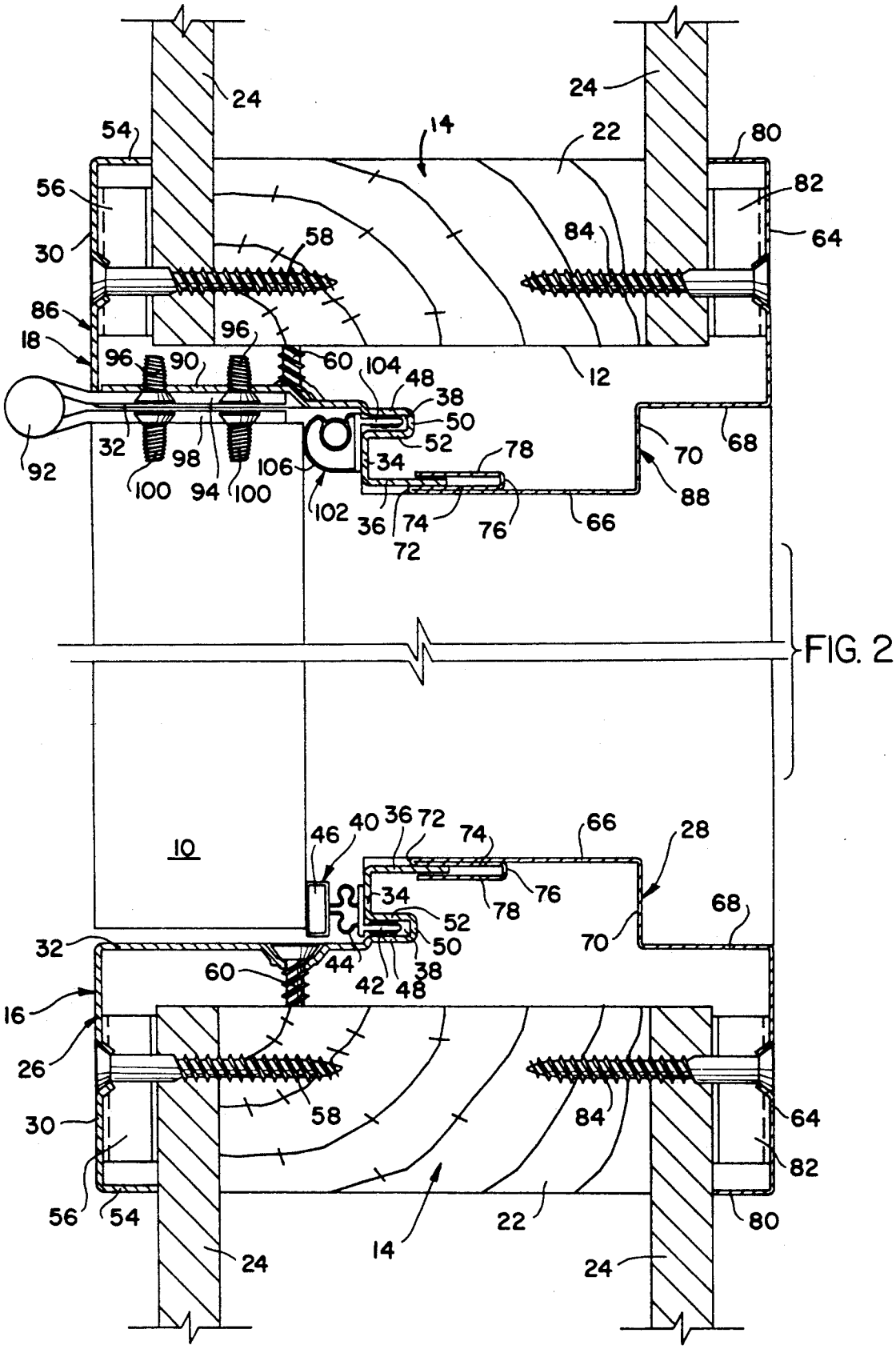
FIG. 2 is a partial, top plan view in section of a door frame according to the present invention.

As illustrated in FIG. 2, latch jamb assembly 16 comprises a latch jamb 26 and a closure jamb 28. Latch jamb 26 and closure 28 form the two members which are adjustable relative to each other to accommodate for the different wall thicknesses and are secured to the wall. Each of the latch jamb and closure jamb is unitarily formed from a single piece of sheet metal, particularly steel.

Latch jamb 26 comprises a flange section of 30 which is planar and overlies a wall surface adjacent doorway 12 in wall 14. An inside section 32 extends substantially perpendicularly from first flange section 30 and into the doorway. The inside section is also essentially planar. The inside section terminates at a door abutment section 34. Door abutment section 34 extends perpendicularly from the inside section at its end remote from flange section 30. The door abutment section extends in a direction parallel to and opposite to flange section 30, i.e., towards the center of the doorway and towards hinge jamb assembly 18. A tongue section 36 is generally planar and extends substantially perpendicularly from door abutment section 34 at its end remote from inside section 32. The tongue section extends in a direction parallel to and opposite to the inside section, i.e., towards closure jamb 28.

Adjacent the juncture of inside section 32 and door abutment section 34 is a groove 38. Groove 38 retains a door seal or weatherseal 40.

A magnetic weatherseal 40 includes a stem 42 located and retained in groove 38, a compressible part 44 attached to this stem and extending outside the groove and a magnetic part 46 attached to the compressible part. The magnetic part overlies the door abutment for engaging the adjacent door edge and providing a seal therebetween.

Groove 48 is defined by portions 48, 50 and 52 of the door abutment section. Portions 48 and 52 are generally parallel to each other and to inside section 32. Portion 50 joins portions 48 and 52 and is perpendicular relative to those two sections.

Flange section 30 terminates at its end remote from inside section 32 in a lip 54. Lip 54 extends substantially perpendicularly from flange section 30, and is parallel to and extends in the same direction as inside section 32.

Latch jamb 26 is mounted to wall 14 with a spacer block 56 located under flange section 30. Screws 58 and 60 extend through countersunk holes in flange section 30 and inside section 32, respectively, and into wall 14 to secure latch jamb 26 in place on the wall. A suitable latch mechanism (not illustrated) can be mounted on inside section 32 to mate with a locking and latching mechanism conventionally used on doors.

Closure jamb 28 has a planar flange section 64 overlying a wall surface adjacent a side of doorway 12 substantially perpendicularly from flange section 64 for extending into the doorway toward and adjacent to inside section 32 of latch jamb 26. Inside section 66 is joined to flange section 64 by two parts 68 and 70, which together define a door abutment section. Part 68 extends directly from flange section 64 and is substantially perpendicular thereto. Part 70 extends perpendicularly from part 68 at an end thereof remote from flange section 64, and is joined directly to and is perpendicular to inside section 66. The door abutment section defined by parts 68 and 70 provides a recess for accommodating a screen or storm door.

Inside section 66 terminates at its end remote from part 70 in a 180° reverse bend 72 to provide a portion 74 overlying a surface of inside section 66 facing the adjacent doorway surface in wall 14. Portion 74 terminates in a right angle bend from which a portion 76 extends. Closure jamb 28 terminates at its free end in a portion 78 which extends perpendicularly from the end of portion 76 remote from portion 74 such that it is parallel to and opposite to, but spaced from, portion 74. In this manner, portions 74, 76, and 78 define a slot therebetween for frictionally engaging tongue section 36.

A lip extends perpendicularly from flange section 64 from its end remote from part 68. The lip extends in the same direction as part 68 and inside section 66, and extends toward wall 14.

Spacer block 82 is provided between flange section 64 and wall 14. To retain closure jamb 28 in place, screws 84 extend through countersunk holes in flange section 64 and into the wall 14, as illustrated.

Hinge jamb assembly 18 comprises a hinge jamb 86 and a closure jamb 88, each of which like latch jamb 26 and closure jamb 28 are unitarily formed from single pieces of sheet metal, particularly steel. Hinge jamb 86 is constructed with a cross-sectional configuration which is substantially identical to latch jamb 26, a except for the preparation for supporting the hinges. Like latch jamb 26, hinge jamb 86 has a lip 54, a flange section 30, an inside section 32, a door abutment section 34 and a tongue section 36. The door abutment section includes a groove 38 adjacent inside section 32 formed of portions 48, 50 and 52. The hinge jamb is mounted with a spacer block 56 between flange 30 and wall 14, and is secured by screws 58 and 60.

At appropriate locations along the length of hinge jamb 86, its inside section has indented portions 90 for accommodating each hinge 92. Hinge 92 comprises a wall plate 94 mounted in the depression formed by indented portion 90 and is secured to the indented portion by screws 96. The door plate 98 is secured to the hinged edge of door 10 by screws 100.

A compression weatherseal 102 is mounted to and attached to door abutment section 34 of hinge jamb 86. Compression seal 102 include a stem 104 secured in hinge jamb groove 38 and a compression part 106 overlying and engaging hinge jamb door abutment section 34 and the adjacent surface of door 10.

Closure jamb 88 is identical to closure jamb 28, and includes a lip 80, a flange-section 64, parts 68 and 70, inside section 66, bend 72 and portions 74, 76 and 78 defining the slot for receiving and frictionally engaging tongue section 36 of hinge jamb 86. A spacer block 82 is located between flange section 64 and wall 15. Closure jamb 88 is secured to the wall by screws 84.

Header assembly 20 comprises a base header 108 and a closure header 110. The base header and the closure header are unitarily formed from single pieces of sheet metal, particularly steel, in the same manner as the previously described latch jamb 26 and closure jamb 28, respectively.

The cross-sectional configuration of base header 108 is essentially identical to that of latch jamb 26. Specifically, base header 108 includes a lip 54, a flange section 30, an inside section 32, a door abutment section 34 and a tongue section 36. Base header door abutment section 34 has a groove 38 adjacent inside section 32 defined by portions 48, 50 and 52. A magnetic weatherseal 50 is supported on the door abutment section, and includes a stem 42 secured in groove 38, a compressible part 44 and a magnetic part 46. A spacer block 56 is located between flange section 30 and wall 14. Base header 108 is secured to wall 14 by screws 58.

Closure header 110 is essentially identical in cross-sectional configuration to closure jambs 28 and 88. Specifically, closure header 110 includes a lip 80, a flange section 64, secondary door abutment parts 68 and 70, inside section 66 and a tongue receiving slot defined by bend 72 and portions 74, 76, and 78.

A spacer block 82 is located between flange section 64 of closure header 110 and wall 14. The closure header is secured to the wall by screws 84.

Each of latch jamb 26, hinge jamb 86, closure jambs 28 and 88, base header 108 and closure header 110 are separately formed in a suitable manufacturing facility. The base header can be attached in a conventional manner to the latch and hinge jambs at the installation site or the manufacturing facility. Similarly, the closure header can be attached in a conventional manner to the closure jambs at the installation site or the manufacturing facility. Once the base header-closure jamb assembly and the closure header-closure jamb assembly are assembled, the two assemblies are connected adjustably by the engagement of the tongue sections 36 in the slots. The adjustment provided by the engagement of the tongues and slots will accommodate variations in the wall thickness. The mounting screws can then be installed to mount and secure the adjustable door frame to wall 14 in the doorway.

The lower ends of the hinge and latch jambs and the closure jambs can be attached to a threshold assembly extending across the floor of the doorway. A typical threshold assembly is illustrated in FIG. 1, and comprises an aluminum extender threshold 112 and a vinyl base threshold on 114. The base threshold 114 engages and mates with a sweep 116 suitably mounted on the door to provide a seal at the lower edge of the door. Such threshold assembly is typically used on an outside entrance door to structure.

A typical spacer block can have a width of about 1 ½ inches and a thickness of about ½ inch. Each of the flange sections typically has a width of approximately 2 inches.

While a particular embodiment has been chosen to illustrate the invention, it will be understood by those skilled in the art that various changes and modifications can be made therein without departing from the scope of the invention as defined in the appended claims.

What is claimed is:

1. An adjustable door frame, comprising: a first member unitarily formed of sheet metal, said first member including a first flange section for overlying a wall surface adjacent a doorway opening in a wall, a first inside section extending substantially perpendicularly from said first flange section for extending into the doorway opening, a first door abutment section extending substantially perpendicularly from said first inside section at an end thereof remote from said first flange section in a direction parallel to and opposite to said first flange section, and a tongue section extending substantially perpendicularly from said first abutment section at an end thereof remote from said first inside section in a direction parallel to and opposite to said first inside section; and a second member unitarily formed of sheet metal, said second member including a second flange section for overlying a wall surface adjacent an opposite side of the doorway opening in the wall, a second inside section extending substantially perpendicularly form said second flange section for extending into the doorway opening toward and adjacent to said first inside section, and a folded back section extending from said second inside section at an end thereof remote from said second flange section and defining a slot receiving and frictionally engaging said tongue section;

whereby engagement of said tongue section in said slot provides an adjustable connection of said first and second members to compensate for varying wall thickness.

2. An adjustable door frame according to claim 1 wherein said first door abutment section comprises a groove adjacent said first inside section; and seal means, for engaging a door mounted by said first and second members, is secured in said groove.

3. An adjustable door frame according to claim 2 wherein said groove is defined by first, second and third portions of said first door abutment section, said first and third portions being generally parallel to each other and said first inside section and perpendicular to said second portion.

4. An adjustable door frame according to claim 2 wherein said seal means comprises an attachment stem secured in said groove and a compressible part overlying said first door abutment section.

5. An adjustable door frame according to claim 2 wherein said seal means comprises an attachment stem secured in said groove and a magnetic weatherseal part overlying said first door abutment section.

6. An adjustable door frame according to claim 5 wherein spacer blocks are mounted under said flange sections.

7. An adjustable door frame according to claim 1 wherein each of said flange sections terminates, at an end thereof remote from the respective inside section, in a lip extending substantially perpendicularly from the respective flange section and parallel to and in the same direction as the respective inside section.

8. An adjustable door frame according to claim 1 wherein said flange sections are flat, planar members.

9. An adjustable door frame according to claim 1 wherein said second member comprises a second door abutment section between said second flange section and said second inside section.

10. An adjustable door frame according to claim 9 wherein said second door abutment section comprises a first extending perpendicularly from said second flange section and a second part extending perpendicularly from said first part at an edge thereof remote from said second flange section.

11. An adjustable door frame, comprising:

a first frame assembly having a latch jamb, a hinge jamb and base header each being unitarily formed of sheet metal and including a first flange section for overlying a wall surface adjacent doorway opening in a wall, a first inside section extending substantially perpendicularly from said first flange section for extending into the doorway opening, a first door abutment section extending substantially perpendicularly from said first inside section at an end thereof remote from said first flange section in a direction parallel to and opposite to said first flange section, and a tongue section extending substantially perpendicularly from said first abutment section at an end thereof remote from said first inside section in a direction parallel to and opposite to said first inside section; and a second frame assembly having two closure jambs and a closure header each being unitarily formed of sheet metal and each including a second flange section for overlying a wall surface adjacent an opposite side of the doorway opening in the wall, a second inside section extending substantially perpendicularly form said second flange section for extending into the doorway opening toward and adjacent to the respective inside section, and a folded back section extending from said second inside section at an end thereof remote from said second flange section and defining a slot receiving and frictionally engaging the respective tongue section;

whereby engagement of said tongue sections in said slots provides an adjustable connection of said first and second frame assemblies to compensate for varying wall thickness.

12. An adjustable door frame according to claim 11 wherein said first door abutment sections comprise grooves adjacent said first inside sections; and seal means, for engaging a door mounted by said first and second frame assemblies, are secured in said grooves.

13. An adjustable door frame according to claim 12 wherein each said groove is defined by first, second and third portions of the respective first door abutment section, said first and third portions of each said groove being generally parallel to each other and the respective first inside section and perpendicular to the respective second portion.

14. An adjustable door frame according to claim 12 wherein said seal means comprises attachment stems secured in said grooves and compressible parts overlying said first door abutment sections.

15. An adjustable door frame according to claim 12 wherein one said seal means comprises an attachment stem secured in one said groove and a magnetic weatherseal part overlying the respective first door abutment section.

16. An adjustable door frame according to claim 11 wherein each of said flange sections terminates, at an end thereof remote from the respective inside section, in a lip extending substantially perpendicularly from the respective flange section and parallel to and in the same direction as the respective inside section.

17. An adjustable door frame according to claim 16 wherein spacer blocks are mounted under said flange sections.

18. An adjustable door frame according to claim 11 wherein said flange sections are flat, planar members.

19. An adjustable door frame according to claim 11 wherein each of said closure jambs and said closure header of said second frame assembly comprises a second door abutment section between said second flange section and said second inside section thereof.

20. An adjustable door frame according to claim 19 wherein each said second door abutment section comprises a first part extending perpendicularly from the respective second flange section and a second part extending perpendicularly from said first part at an edge thereof remote from the respective second flange section.

* * * * *